US008920198B2

(12) United States Patent
Ruschel et al.

(10) Patent No.: US 8,920,198 B2
(45) Date of Patent: Dec. 30, 2014

(54) ELECTRICAL CONNECTING ELEMENT AND COMBINATION COMPRISING AN ELECTRICAL CONNECTING ELEMENT AND COMPONENT

(71) Applicant: Biotronik SE & Co. KG, Berlin (DE)

(72) Inventors: Marina Ruschel, Berlin (DE); Kathy Hartmann-Bax, Berlin (DE); Jan Litzke, Berlin (DE)

(73) Assignee: Biotronik SE & Co. KG, Berlin (DE)

( * ) Notice: Subject to any disclaimer, the term of this patent is extended or adjusted under 35 U.S.C. 154(b) by 155 days.

(21) Appl. No.: 13/711,623

(22) Filed: Dec. 12, 2012

(65) Prior Publication Data

US 2013/0183863 A1 Jul. 18, 2013

Related U.S. Application Data

(60) Provisional application No. 61/585,656, filed on Jan. 12, 2012.

(51) Int. Cl.

| | |
|---|---|
| ***H01R 24/66*** | (2011.01) |
| ***H01R 13/46*** | (2006.01) |
| ***H01R 12/70*** | (2011.01) |
| ***H01R 13/516*** | (2006.01) |
| ***H01R 13/73*** | (2006.01) |
| ***H01R 24/60*** | (2011.01) |
| *H01R 12/57* | (2011.01) |
| *H01R 107/00* | (2006.01) |

(52) U.S. Cl.

CPC ..... *H01R 13/46* (2013.01); *H01R 12/7052* (2013.01); *H01R 13/516* (2013.01); *H01R 13/73* (2013.01); *H01R 24/60* (2013.01); *H01R 12/57* (2013.01); *H01R 24/66* (2013.01); *H01R 2107/00* (2013.01); *H01R 2201/12* (2013.01)

USPC ..... 439/660

(58) Field of Classification Search

USPC ..... 439/660, 78, 736, 79, 83, 590

See application file for complete search history.

(56) References Cited

U.S. PATENT DOCUMENTS

| | | | | | |
|---|---|---|---|---|---|
| 2,903,504 | A | * | 9/1959 | Tuck | 174/152 R |
| 4,474,420 | A | * | 10/1984 | Nestor | 439/498 |
| 4,583,807 | A | * | 4/1986 | Kaufman et al. | 439/83 |
| 4,784,618 | A | * | 11/1988 | Sakamoto et al. | 439/620.1 |
| 5,580,269 | A | * | 12/1996 | Fan | 439/79 |

(Continued)

FOREIGN PATENT DOCUMENTS

| | | |
|---|---|---|
| DE | 3728456 | 3/1989 |
| EP | 1855361 | 11/2007 |
| WO | 2010/094208 | 8/2010 |

OTHER PUBLICATIONS

European Search Report dated Jun. 21, 2013, 7 pages.

*Primary Examiner* — Alexander Gilman

(74) *Attorney, Agent, or Firm* — Arc IP Law, PC; Joseph J. Mayo

(57) ABSTRACT

An electrical connecting element (10) comprising at least one carrier body (50) and at least one electrical contact body (20) extending on both sides (52, 54) of the carrier body (50). The at least one electrical contact body (20) is arranged on an insulating body (60), which is coupled to the carrier body (50). At least one embodiment of the invention refers to a combination comprising a connecting element (10) and a component, and to an electrical device (110) comprising a connecting element (10).

18 Claims, 8 Drawing Sheets

(56) References Cited

U.S. PATENT DOCUMENTS

| | | | | |
|---|---|---|---|---|
| 5,692,912 | A * | 12/1997 | Nelson et al. | 439/79 |
| 6,506,083 | B1 * | 1/2003 | Bickford et al. | 439/736 |
| 7,390,199 | B2 * | 6/2008 | Honda et al. | 439/78 |
| 7,419,385 | B2 * | 9/2008 | Itou et al. | 439/76.1 |
| 7,556,510 | B2 * | 7/2009 | Tsuruzawa et al. | 439/83 |
| 8,326,425 | B2 * | 12/2012 | Sprain et al. | 607/36 |
| 2007/0232119 | A1 * | 10/2007 | Sprain et al. | 439/357 |

* cited by examiner

ELECTRICAL CONNECTING ELEMENT AND COMBINATION COMPRISING AN ELECTRICAL CONNECTING ELEMENT AND COMPONENT

This application claims the benefit of U.S. Provisional Patent Application 61/585,656 filed on 12 Jan. 2012, the specification of which is hereby incorporated herein by reference.

BACKGROUND OF THE INVENTION

1. Field of the Invention

At least one embodiment of the invention relates to an electrical connecting element and to a combination comprising a connecting element and a component.

2. Description of the Related Art

Typically, plug-on electrical modules or assemblies are electrically connected to various electrical devices, such as defibrillators. For this purpose, frequently, individual contact pins having corresponding plug contacts are connected manually. Feedthrough pins to the outside wiring are unfavorable to attach by welding and require a complex design and/or separate connecting processes.

BRIEF SUMMARY OF THE INVENTION

It is the object of the invention to provide a connecting element and a combination that facilitates the electrical connection of a module or an assembly to the connecting element or an electrical device.

The object is achieved according to at least one embodiment of the invention as claimed herein. Favorable embodiments and advantages of at least one embodiment of the invention will become apparent hereinafter from the description of exemplary embodiments.

At least one embodiment of the invention relates to an electrical connecting element, which comprises at least one carrier body and at least one electrical contact body extending on both sides of the carrier body, wherein the at least one electrical contact body is arranged on an insulating body, which is coupled to the carrier body.

The electrical connecting element can advantageously be employed for electrically connecting an electrical component of an assembly. The electrical connecting element can notably be inserted as a feedthrough in a housing, in which a component or an assembly is to be electrically connected from the outside. The electrical connecting element leads electrical connections from one side of the connecting element to the other side transversely to the longitudinal direction, such as along a vertical direction of the electrical connecting element. The electrical connecting element may be fitted with contact bodies, which are intended to establish the electrical connection between two components, transversely to a longitudinal extension and to the vertical direction, on one side or on both sides, at regular intervals or in steps. When fitted in steps, the contact bodies can be arranged in parallel rows, with varying respective stepped heights relative to each other.

The connecting element allows high mechanical stability, which is advantageous for the subsequent manufacturing steps, and in particular for the joining steps. It is possible, for example, to rigidly join the contact bodies on one side of the electrical connecting element to contact surfaces of a printed circuit board, for example, while the regions of the contact bodies on the opposite side can serve as terminals for a plug. Optionally, terminal elements can be provided in these regions of the contact bodies so as to connect a mating element thereto, for example contact tabs, contact springs and the like. Because of the high mechanical stability, such terminal elements can be easily joined to the contact bodies.

The contact bodies can advantageously be formed by flat strip stock. This yields a planar electrical contact having low contact resistance. Joining contact surfaces or terminal elements can be carried out reliably and reproducibly.

According to an advantageous embodiment, the insulating body can comprise receptacles for contact bodies, the receptacles being mutually spaced in the longitudinal direction of the insulating body and transversely to the vertical direction and transverse direction. The receptacles also insulate adjoining contact bodies in the longitudinal or transverse directions of the insulating body with respect to each other, or both. A space-saving and electrically safe arrangement of the contact bodies is possible. The insulating body can extend an electrical creep section between adjoining contact bodies, while reducing the size of the feedthrough at the same time. Flashover of electrical potentials between different contact bodies can be effectively suppressed.

The contact bodies can notably be arranged on both sides of a partition along the longitudinal extension of the insulating body. This allows a high terminal density. The length of the insulating body can be easily adapted to the number of required contact bodies. Moreover, the contact bodies can be used to fix and position components or assemblies that are to be connected to the electrical connecting element. The electrical connecting element can be used, for example, for preassembled outside wiring of a device or an assembly, to which a header or other components, such as sensors or the like, can be electrically connected. The header is used to make contact with an electrode. The feedthrough and outside wiring, for example, can be arranged in the header, which can optionally be sealed in a liquid-tight manner. The header generally comprises at least one opening with terminal bodies or connection sockets, which are electrically connected via the outside wiring to the contact bodies.

The receptacles for the contact bodies can advantageously be arranged in a grid spacing along the longitudinal extension. The insulating body can thus have a modular design. For the mating elements of the components to be connected, the electrical terminals can correspondingly be provided in the same grid spacing. This allows the components, or the electrical contacts thereof, to be standardized. The predefined geometry allows automated processes for establishing the connection. Joining processes when producing the electrical connecting elements, as well as the mating elements of the components to be connected to, can be simplified.

According to a favorable embodiment, the insulating body can extend through the carrier body. The carrier body can notably serve as a seat against a housing wall.

According to a favorable embodiment, the insulating body may widen in the region of a feedthrough for the contact body, or contact bodies, through the carrier body. This results in a particularly stable arrangement and allows electrical insulation of the contact bodies.

Advantageously, the contact body, or the contact bodies, can protrude over the carrier body and the insulating body on at least one side of the carrier body. Advantageously, the distance can achieve electrical insulation, if electrical potential is present on the housing, via a flange. This is not something that is desirable. A distance is required for the purpose of insulation.

According to an advantageous embodiment, one or more contact bodies may have an angled profile comprising at least two limbs, wherein one limb can extend transversely to the other limb. An approximately L-shaped profile of the contact body is advantageous, for example.

According to a favorable embodiment, the carrier body can comprise at least one positioning unit for locally positioning the electrical connecting element. The positioning unit can in particular be aligned with at least one end of the contact body. This allows for good positioning accuracy of the electrical connecting element with respect to a component to be connected, such as a printed circuit board. The positioning unit can comprise a positioning pin or several positioning pins, that can be designed as plug contacts. As an alternative, the pin, or the pins, can be joined to the printed circuit board like the contact bodies. In addition, the positioning unit can advantageously fulfill a mechanical retaining function if it is soldered to the printed circuit board using an SMD technique.

According to a favorable embodiment, the contact body can be formed of a composite material, more particularly of two or more metallically conducting materials, for example pure metals or alloys, or composed of two or more materials, or both. The materials are usually joined by a non-positive or positive connection, or a combination thereof. However, it is also conceivable to form the contact bodies of a material that includes a metallically conducting material, such as at least one from the group consisting of niobium, titanium, tantalum, gold, stainless steel, platinum, iridium, a nickel alloy such as MP-35N, or a mixture of two or more of the materials.

A further aspect of the invention relates to a combination comprising a connecting element and at least one of the aforementioned features and an electrical component in the form of a printed circuit board.

According to a further favorable embodiment, the one limb can serve as an electrical contact for an electrical mating contact of a first electrical component and the other limb can be provided as an electrical contact of a second electrical component. The other limb can notably be connectable to a circuit board. The connecting element is suitable in particular for surface mounting, using an SMD technique. The connecting element can thus be joined to a printed circuit board.

A further aspect of the invention relates to an electrical device, comprising a connecting element or a combination comprising a connecting element and an electrical component in the form of a printed circuit board, or both.

At least one embodiment of the invention allows for an automated welding and/or soldering process. The insulating body, which forms a bridge along the longitudinal extension thereof, results in a stable substrate during the joining process, whereby handling of the elements is simplified. The positioning unit allows exact positioning as well as fixation, which facilitates the attachment of a mountable assembly, such as a header, or preassembled outside wiring or other components to be connected, such as sensors. The positioning unit can moreover be used for the mechanical retention of the printed circuit board. In addition, the option exists to anchor an assembly, such as a header, directly on or in a housing via the connecting element.

BRIEF DESCRIPTION OF THE DRAWINGS

The invention will be described in more detail hereafter by way of example based on exemplary embodiments illustrated in the drawings. In the drawings, shown in schematic illustrations.

DETAILED DESCRIPTION OF THE INVENTION

Figure 1:
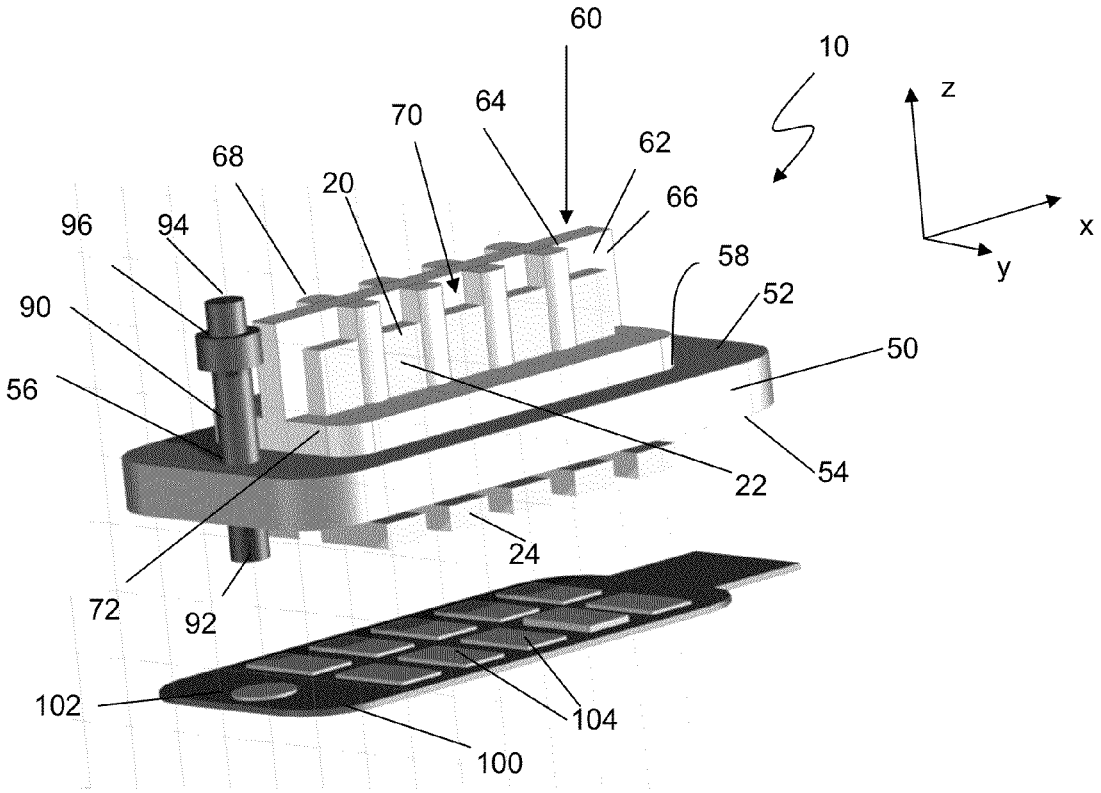
FIG. 1 is a perspective view of a favorable embodiment of a connecting element according to the invention.
Figure 2A:
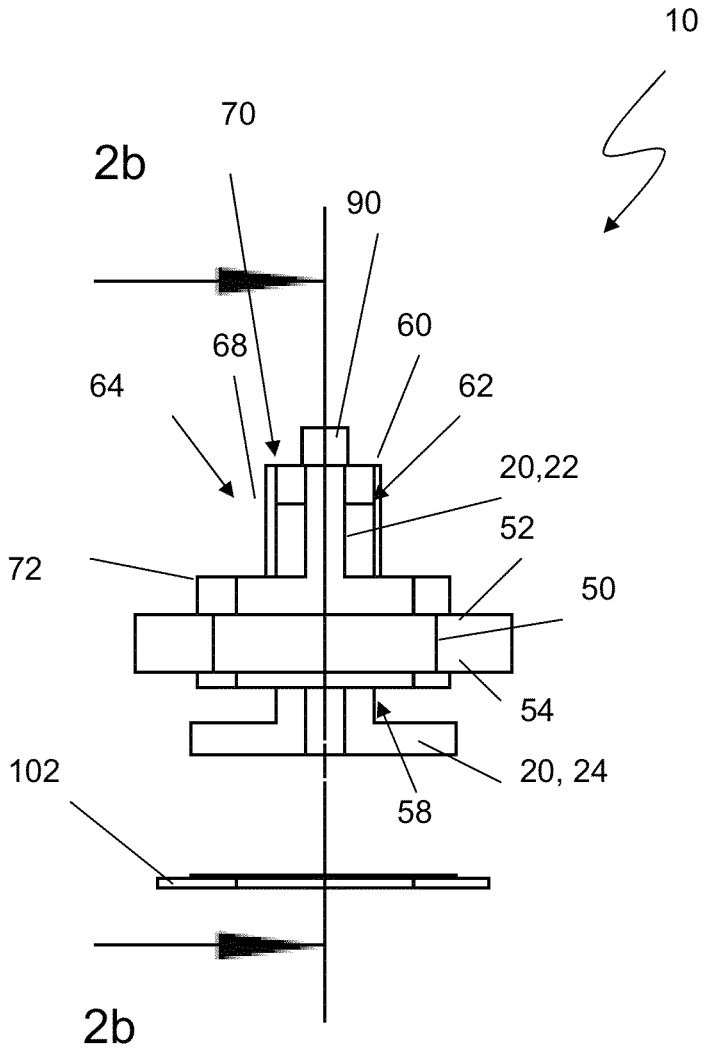
FIGS. 2*a*, 2*b* are top views of a narrow side of the connecting element of FIG. 1 (FIG. 2*a*) and of a longitudinal section along line 2*b*-2*b* (FIG. 2*b*)
Figure 2B:
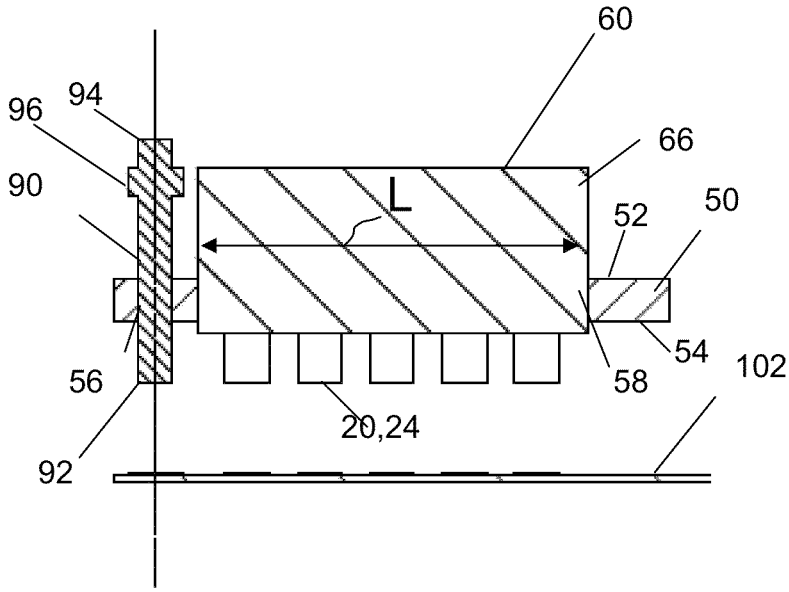
Figure 3A:
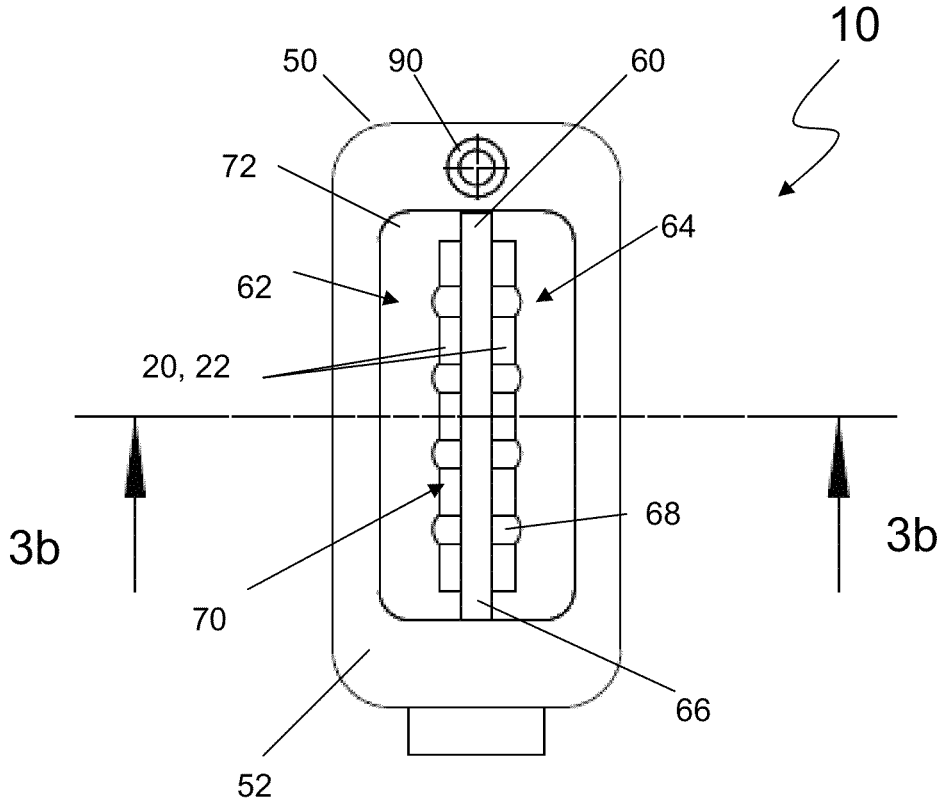
FIGS. 3*a*, 3*b* are top views of the top side of the connecting element of FIG. 1 (FIG. 3*a*) and a section along line 3*b*-3*b* (FIG. 3*b*)
Figure 3B:
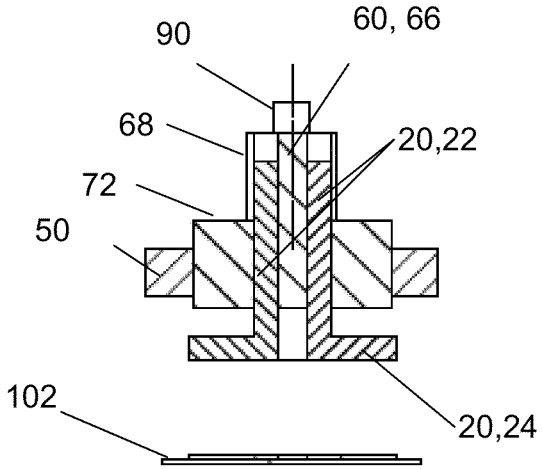

In the figures, functionally equivalent or equivalently acting elements are denoted by the same reference numerals. The figures are schematic illustrations of at least one embodiment of the invention. They depict non-specific parameters of at least one embodiment of the invention. In addition, the figures only reflect typical embodiments of the invention and are not intended to limit the invention to the embodiments that are illustrated.

FIGS. 1, 2*a*, 2*b*, 3*a*, 3*b* show various views and sections of a favorable embodiment of a connecting element 10 according to at least one embodiment of the invention, wherein FIG. 1 shows a perspective view of a favorable embodiment of an electrical connecting element 10, as well as a combination comprising the connecting element 10 and an electrical component, for example a printed circuit board 100, to which the connecting element 10 can be connected, in particular by way of a joining process. In the embodiment shown, contact bodies 20 are arranged mirror-symmetrically relative to a centerline.

The connecting element 10 comprises a carrier body 50, which bears an insulating body 60. The carrier body 50 has a top side 52 and a bottom side 54. The insulating body 60 is inserted, for example, in an opening 58 of the carrier body 50. It is also conceivable to design the insulating body 60 and carrier body 50 as one piece. The insulating body 60 can advantageously be made of a ceramic material. The use of plastic material or another non-conductive material is also conceivable for the insulating body 60.

The insulating body 60 has a longitudinal extension L in the x direction, as well as a vertical direction in the z direction and a transverse direction in the y direction. The insulating body 60 comprises a bridge-like partition 66, which extends in the longitudinal direction and is widened on both sides, 62,64 thereof, in the transverse direction (y direction) at regular intervals by transverse elements 68. The insulating body 60 extends through the carrier body 50, protrudes over the top side 52 and also projects slightly over the bottom side 54 on the bottom side 54. The distance can be used for electrical insulation.

However, the insulating body 60 can also be aligned, as needed, with the bottom side 54, or extend less into the opening 58 than the thickness of the carrier body 50.

In the region of the opening 58 of the carrier body 50, the insulating body 60 is widened on both sides 62,64 and comprises a region 72 through which the opening 58 extends. This improves the guidance of the contact bodies 20, which is described below. A positioning unit 90, which is designed as a pin, for example, and is guided in an opening 56 through the carrier body 50, is arranged in the longitudinal direction L next to the insulating body 60.

The insulating body 60 comprises receptacles 70 for contact bodies 20, the receptacles being arranged at regular intervals along the longitudinal extension L. The contact bodies 20 extend along the vertical direction (z direction) through the carrier body 50 and the insulating body 60 which widens toward both sides 62,64. A first limb 22 is accessible on the top side 52 of the carrier body 50, and a second limb 24 on the bottom side 54.

As is indicated in FIG. 1, the second limbs 24 are used to make contact with a component 100, for example contact surfaces 104 of a printed circuit board 102, by which the connecting element 10 can be joined via the contact bodies 20 to form a combination. The printed circuit board 102 can contain, for example, lines or integrated circuits, and can comprise electrical components that are surface-mounted using an SMD technique.

The positioning unit 90 can be arranged such that the lower end 92 thereof is aligned with the bottom side of the second limbs 24 of the contact bodies 20. This can provide an additional retaining function, because the positioning unit can be soldered to a corresponding contact surface 104 of the printed circuit board 102 using an SMD technique. The upper end 94 can protrude over the insulating body 60 and be used to position elements that are to be electrically connected to the connecting element 10. A widened region 96 at the upper end 94 allows for better handling and, because of an undercut at the lower end, allows for widening of the mechanical anchoring, for example for anchoring a potting compound or the plastic material of the header (not shown).

The contact bodies 20 are arranged, for example, on both sides 62,64 of the insulating body 60 and are preferably produced from flat strip stock.

Figure 4:
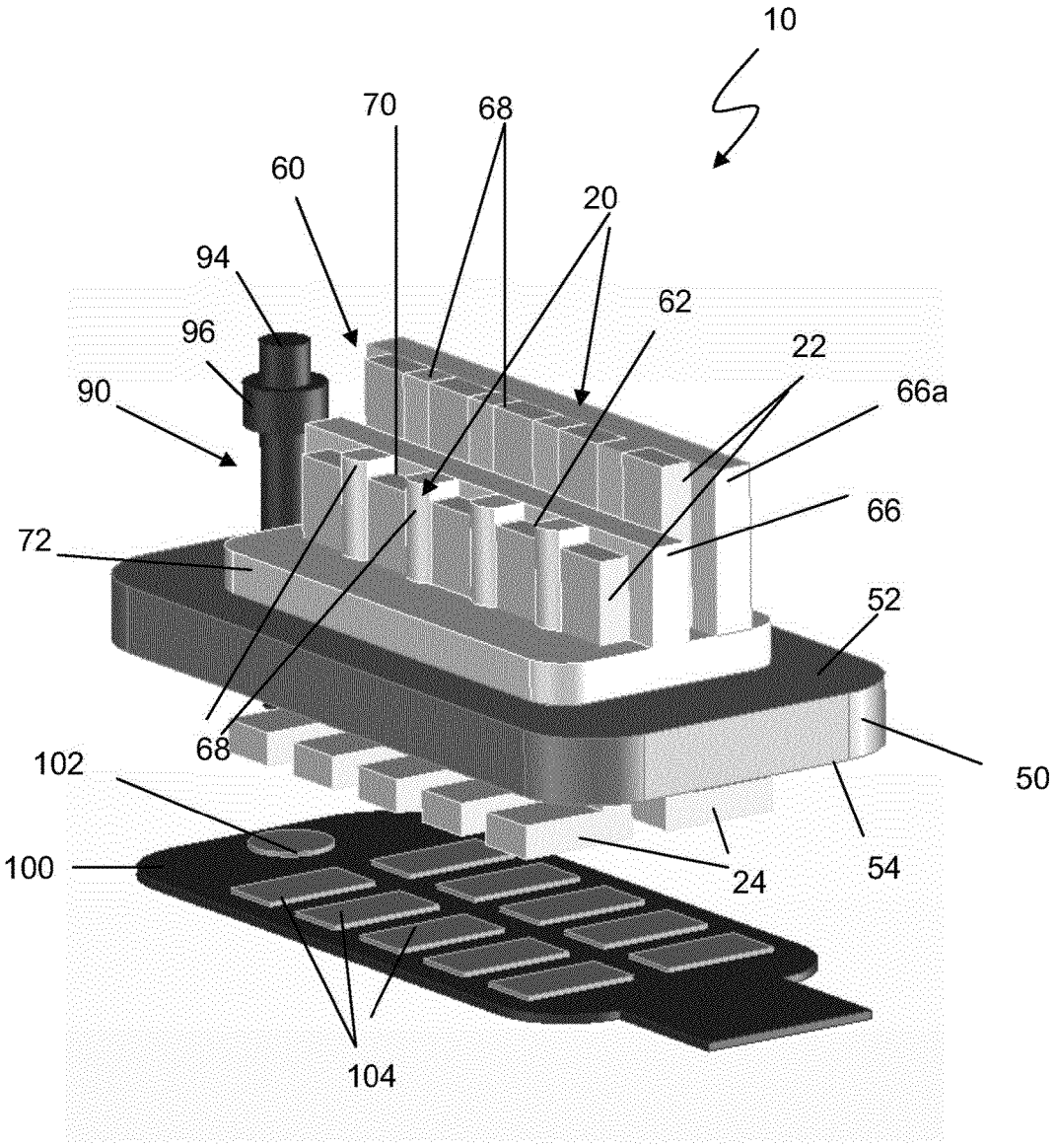
FIG. 4 is a variant of a connecting element, comprising contact bodies that are arranged on one side which are stepped in terms of the height thereof.

FIG. 4 shows a variant of a connecting element 10 comprising stepped rows of contact bodies 20, which are arranged at the same height in the respective row, wherein the rows are arranged parallel to the bridge-like partition 66 of the insulating body 60, and wherein the different rows are respectively stepped in terms of the height thereof, having a height that ascends from the outside to the inside. An outside wall 66*a* is arranged parallel to the bridge-like partition 66 such that the rows of contact bodies 20 are arranged on one side of the bridge-like outside wall 66*a*, and thus on one side in relation to a lateral face of the insulating body 60. It is thus advantageously possible to install the parts to be connected from one side.

Figure 5A:
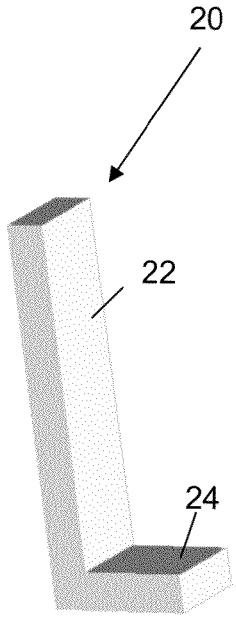
FIGS. 5*a*, 5*b* shows views of a favorable embodiment of a contact body (FIG. 5*a*) and of a preliminary stage of the contact body during production (FIG. 5*b*)

The contact bodies 20 each have an L-shaped profile, which is shown in more detail in FIG. 5*a*. The contact body 20 has a first limb 22, and a limb 24 arranged transversely thereto, and is preferably formed of flat strip stock. The contact bodies 20, however, can also have different profiles, for example formed of linear strip stock.

Figure 5B:
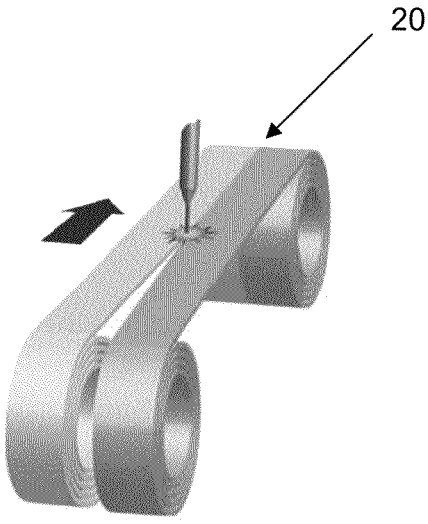

The material of which the contact body 20 is formed of is metallically conductive, and can be, for example, a metal, a metal mixture or an alloy. Moreover, the contact body 20 can be formed of a composite material, which is composed of two or more material bodies. For example, strips can be joined along the lateral edges thereof, for example by welding, as is indicated in FIG. 5*b*. It is also possible to connect strips at the flat faces to each other. The strips can be entirely or partially coated, for example they can be tin-plated as solderable components.

The contact bodies 20 can be rigidly inserted into the openings 68 of the insulating body 60, for example by soldering, gluing, molding, welding or insert molding. Because of the grid spacing-like arrangement along the insulating body 60, the number of terminals of the connecting element 10 can be easily expanded, and the insulating body 60 can notably have a modular design.

The flat strip stock of the contact body 20 and insulating body 60 forms a sufficiently stable substrate for a secure joining process, or spring contacting of the connecting element 10. The connecting element 10 can be soldered on using an SMD technique. The positioning unit 90 provides advantageous fixation for the printed circuit board 102.

Figure 6:
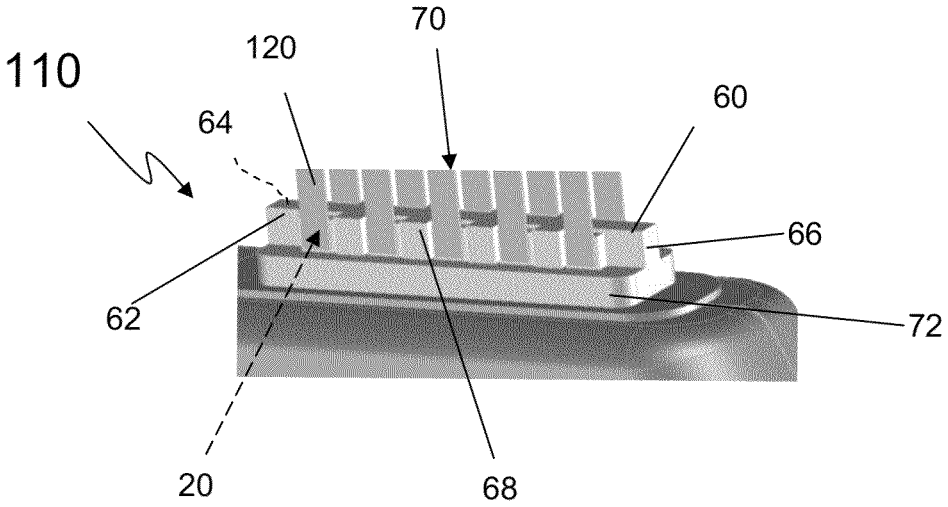
FIG. 6 is an example of an electrical device comprising an embodiment of a connecting element that is integrated in the device and connected to outside wiring of the device.

FIG. 6 illustrates a favorable embodiment of an electrical device 110, which comprises a connecting element 10 and/or a combination comprising a connecting element 10 and a component 100, such as printed circuit board 102. Extensions 120 are provided on the contact bodies 20, which form the outside wiring of the device 110 and can be electrically connected, for example, to functional assemblies, components such as sensors, and the like.

It will be apparent to those skilled in the art that numerous modifications and variations of the described examples and embodiments are possible in light of the above teaching. The disclosed examples and embodiments are presented for purposes of illustration only. Other alternate embodiments may include some or all of the features disclosed herein. Therefore, it is the intent to cover all such modifications and alternate embodiments as may come within the true scope of this invention.

What is claimed is:

1. An electrical connecting element comprising:

a carrier body with a top side and a bottom side;

at least one electrical contact body extending on both said top side and said bottom side of the carrier body;

wherein the at least one electrical contact body is angled and comprises at least two limbs, and wherein the at least two limbs comprise at least one first limb extending transversely to at least one second limb;

an insulating body coupled to the carrier body;

wherein the insulating body extends through the carrier body, protrudes over said top side, and projects over said bottom side on said bottom side or is aligned with said bottom side or extends through said carrier body less than a thickness of said carrier body;

wherein the at least one electrical contact body is arranged on the insulating body;

wherein the carrier body comprises an opening next to said insulating body and at least one positioning unit that locally positions the electrical connecting element;

wherein said positioning unit is guided in said opening in a logitudinal direction and extends through said top side and said bottom side of said carrier body;

wherein the positioning unit is aligned at least on one end with the at least one electrical contact body; and, wherein the at least one positioning unit comprises a lower end and an upper end, such that the lower end is aligned with a bottom side of said at least one second limb, and the upper end protrudes over said insulating body.

2. The electrical connecting element according to claim 1, wherein the insulating body comprises receptacles for the at least one electrical contact body; and, wherein the receptacles are mutually spaced in a longitudinal direction of the insulating body and are configured to insulate adjoining contact bodies in the longitudinal or transverse directions of the insulating body with respect to each other, or both.

3. The electrical connecting element according to claim 1, wherein the at least one electrical contact body is arranged on both sides of the insulating body.

4. The electrical connecting element according to claim 1, wherein the at least one electrical contact body comprises a plurality of contact bodies arranged on one side in relation to a lateral face of the insulating body, or arranged in steps in relation to each other, or both.

5. The electrical connecting element according to claim 4, wherein the insulating body comprises a bridged-partition, and wherein the plurality of contact bodies are arranged in stepped rows parallel to the bridged-partition.

6. The electrical connecting element according to claim 5, wherein the stepped rows vary in height in an ascending manner.

7. The electrical connecting element according to claim 5, wherein the bridged-partition comprises two sides and extends in the longitudinal direction, and wherein the bridged-partition is widened on both said two sides in a transverse direction at regular intervals by tranverse elements.

8. The electrical connecting element according to claim 1, wherein the insulating body extends through the carrier body.

9. The electrical connecting element according to claim 1, further comprising a feedthrough and feedthrough region for the at least one electrical contact body, wherein the insulating body is wider in the feedthrough region.

10. The electrical connecting element according to claim 1, wherein the at least one electrical contact body protrudes over the carrier body and the insulating body on at least one side of the carrier body.

11. The electrical connecting element according to claim 1, wherein the at least one electrical contact body is formed of a composite material.

12. The electrical connecting element according to claim 11, wherein the at least one positioning unit comprises at least one pin.

13. The electrical connecting element according to claim 1, further comprising an electrical component.

14. The electrical connecting element according to claim 13, wherein the electrical component is a printed circuit board.

15. The electrical connecting element according to claim 13, wherein the electrical component comprises an electrical mating contact; and, wherein at least one limb of the at least two limbs is configured as an electrical contact for the electrical mating contact, and is connected to the electrical mating contact.

16. The connecting element according to claim 1, wherein the at least one electrical contact body comprises a plurality of contact bodies arranged in parallel rows.

17. The electrical connecting element according to claim 1, wherein the insulating body comprises a longitudinal extension, and further comprises receptacles for the at least one electrical contact body, wherein the receptacles are arranged in a grid spacing along the longitudinal extension of the insulating body.

18. The electrical connecting element according to claim 1, wherein the carrier body comprises an opening and wherein the insulating body is inserted in said opening.

* * * * *